US011492851B2

(12) United States Patent
Grosz

(10) Patent No.: US 11,492,851 B2
(45) Date of Patent: Nov. 8, 2022

(54) HYBRID DRILL BIT WITH AXIALLY ADJUSTABLE COUNTER-ROTATION CUTTERS IN CENTER

(71) Applicant: Halliburton Energy Services, Inc., Houston, TX (US)

(72) Inventor: Gregory Christopher Grosz, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/102,980

(22) Filed: Nov. 24, 2020

(65) Prior Publication Data

US 2021/0079731 A1 Mar. 18, 2021

Related U.S. Application Data

(62) Division of application No. 16/067,567, filed as application No. PCT/US2016/019691 on Feb. 26, 2016, now Pat. No. 10,876,360.

(51) Int. Cl.

| | |
|---|---|
| ***E21B 10/20*** | (2006.01) |
| ***E21B 10/14*** | (2006.01) |
| ***E21B 10/62*** | (2006.01) |

(52) U.S. Cl.

CPC ..... *E21B 10/20* (2013.01); *E21B 10/14* (2013.01); *E21B 10/62* (2013.01)

(58) Field of Classification Search

CPC ..... E21B 10/20; E21B 10/62; E21B 10/14; E21B 47/00

See application file for complete search history.

(56) References Cited

U.S. PATENT DOCUMENTS 1,692,793 A * 11/1928 Reed ..... E21B 10/20 175/369
2,210,279 A 8/1940 Catland
(Continued)

FOREIGN PATENT DOCUMENTS

CN 104131787 A 11/2014
CN 104508230 A 4/2015
(Continued)

OTHER PUBLICATIONS

China National Intellectual Property Administration, Application No. 201680077716.9, Translation of First Office Action and Search Report, dated Mar. 27, 2019, 14 pages, China.
(Continued)

*Primary Examiner* — Nicole Coy
*Assistant Examiner* — Yanick A Akaragwe
(74) *Attorney, Agent, or Firm* — Thomas Rooney; C. Tumey Law Group PLLC

(57) ABSTRACT

A hybrid drill bit includes both fixed cutting elements and an adjustable cutting structure thereon. An adjustment mechanism is provided to allow an axial position of cutting elements at a leading end of the adjustable cutting structure to be adjusted with respect to an axial position of the fixed cutting elements. The adjustable cutting structure may include counter rotational cutting members mounted obliquely with respect to a bit body rotational axis, and the adjustment mechanism may dynamically support the adjustable cutting structure such that the axial position of the cutting elements may be adjusted as the drill bit is in operation within a wellbore. The axial position may be adjusted by altering a weight applied to the drill bit within the wellbore.

20 Claims, 5 Drawing Sheets

(56) References Cited

U.S. PATENT DOCUMENTS

| | | | | |
|---|---|---|---|---|
| 2,524,428 | A * | 10/1950 | Day | E21B 10/14 175/339 |
| 4,386,422 | A * | 5/1983 | Mumby | E21B 47/18 367/83 |
| 4,729,440 | A * | 3/1988 | Hall | B22F 7/06 51/293 |
| 4,738,322 | A * | 4/1988 | Hall | E21B 10/22 175/371 |
| 5,343,964 | A | 9/1994 | Leroy | |
| 6,142,250 | A | 11/2000 | Griffin et al. | |
| 7,225,886 | B1 | 6/2007 | Hall | |
| 7,337,858 | B2 | 3/2008 | Hall et al. | |
| 7,392,857 | B1 | 7/2008 | Hall et al. | |
| 7,845,435 | B2 | 12/2010 | Zahradnik et al. | |
| 8,141,664 | B2 | 3/2012 | Zahradnik et al. | |
| 8,336,646 | B2 | 12/2012 | Kulkarni | |
| 8,356,398 | B2 | 1/2013 | McCormick et al. | |
| 8,678,111 | B2 | 3/2014 | Zahradnik et al. | |
| 2004/0182579 | A1 | 9/2004 | Steele et al. | |
| 2007/0221408 | A1 | 9/2007 | Hall et al. | |
| 2011/0079444 | A1 | 4/2011 | Kulkarni | |
| 2011/0162893 | A1 | 7/2011 | Zhang | |
| 2011/0165786 | A1* | 7/2011 | Emerson | E21B 43/128 439/278 |
| 2012/0111638 | A1 | 5/2012 | Nguyen et al. | |
| 2012/0255788 | A1 | 10/2012 | Schwefe et al. | |
| 2013/0220706 | A1 | 8/2013 | Azar et al. | |
| 2013/0313021 | A1 | 11/2013 | Zahradnik et al. | |
| 2014/0174827 | A1 | 6/2014 | Schen et al. | |
| 2014/0311801 | A1 | 10/2014 | Jain et al. | |
| 2014/0353046 | A1 | 12/2014 | Zhang et al. | |
| 2014/0360790 | A1* | 12/2014 | Paros | E21B 10/46 175/426 |

FOREIGN PATENT DOCUMENTS

| | | | |
|---|---|---|---|
| WO | WO-2010099075 | A1 | 9/2010 |
| WO | WO-2014022335 | A1 | 2/2014 |

OTHER PUBLICATIONS

China National Intellectual Property Administration, Application No. 201680077716.9, First Office Action and Search Report, dated Mar. 27, 2019, 10 pages, China.

Korean Intellectual Property Office, International Search Report and Written Opinion, PCT/US2016/019691, dated Nov. 24, 2016, 13 pages, Korea.

Examination Report issued for Australian Patent Application No. 2017416525, dated May 19, 2022, 3 pgs.

* cited by examiner

HYBRID DRILL BIT WITH AXIALLY ADJUSTABLE COUNTER-ROTATION CUTTERS IN CENTER

CROSS-REFERENCE TO RELATED APPLICATIONS

This application is a Continuation of U.S. patent application Ser. No. 16/067,567, filed on Jun. 29, 2018, which is a U.S. national stage patent application of International Patent Application No. PCT/US2016/019691, filed on Feb. 26, 2016, the benefit of which is claimed and the disclosure of each of which is incorporated herein by reference in its entirety.

BACKGROUND

The present disclosure relates generally to downhole tools such as drill bits useful in operations related to oil and gas exploration, drilling and production. More particularly, the disclosure relates to drill bits including cutting elements with an axially adjustable position with respect to a bit body.

Often in operations for the exploration, drilling and production of hydrocarbons, water, geothermal energy or other subterranean resources, a rotary drill bit is used to form a wellbore through a geologic formation. Rotary drill bits may generally be classified as either fixed-cutter drill bits with stationary cutting elements (often referred to as "drag bits"), roller-cone drill bits with cutting elements mounted on one or more roller cones that are mounted for rotation with respect to a bit body of the drill bit.

Fixed-cutter drill bits may be constructed with a plurality of fixed cutting elements mounted to the bit body. The bit body for a fixed-cutter drill bit may be constructed of a metallic material such as steel or a matrix material formed by infiltrating a reinforcement material with a molten binder. The fixed cutting elements can be affixed to an outer profile of the bit body such that hard surfaces on the cutting elements are exposed to the geologic formation when forming a wellbore. The cutting elements generally operate to remove material from the geologic formation, typically by shearing formation materials as the drill bit rotates within the wellbore. Roller-cone drill bits may be constructed of one or more roller cones rotatably mounted to the bit body, wherein cutting elements are disposed on the roller cones. The roller cones roll along the bottom of a wellbore as the roller-cone drill bit is rotated. The cutting elements on the roller cones generally operate to remove material from the geologic formation, typically by crushing, gouging and/or scraping material from the geologic formation to drill the wellbore.

Hybrid drill bits have been developed with features of both fixed-cutter and roller-cone drill bits for various purposes. For example, in some instances, a hybrid drill bit may be more durable, thereby permitting greater depths to be drilled before requiring maintenance or replacement of the drill bit than either a fixed-cutter drill bit or roller-cone drill bit alone. A hybrid drill bit may also enhance characteristics tailored to a particular application such as steerability, stability, etc.

The cutting elements on fixed-cutter drill bits, roller-cone drill bits and hybrid drill bits are subject to varying degrees of wear and tear as the drill bit progress through regions of the geologic formation having differing hardness, density and/or other formation parameters. The wear and tear on the cutting elements often requires servicing or replacement of the drill bit, which may be cost and time prohibitive during a drilling operation. In some instances, the amount of wear and tear on the cutting elements may be affected by parameters such as the weight applied on the drill bit, a rate of penetration through the geologic formation and an axial distance one or more cutting elements protrude from the bit body.

BRIEF DESCRIPTION OF THE DRAWINGS

The disclosure is described in detail hereinafter, by way of example only, on the basis of examples represented in the accompanying figures, in which.

DETAILED DESCRIPTION

In the following description, even though a figure may depict an apparatus in a portion of a wellbore having a specific orientation, unless indicated otherwise, the apparatus according to the present disclosure may be equally well suited for use in wellbore portions having other orientations including vertical, slanted, horizontal, curved, etc. Likewise, unless otherwise noted, even though a figure may depict a terrestrial drilling operation, the apparatus according to the present disclosure is equally well suited for use in offshore or subsea operations. Further, unless otherwise noted, even though a figure may depict an open hole wellbore, the apparatus according to the present disclosure may be equally well suited for use in slotted liner or partially cased wellbores.

The present disclosure includes drill bits that include an adjustable cutting structure mounted on the bit body, the adjustable cutting structure including at least one cutting element. For example, the drill bit could be a hybrid drill bit optionally including fixed cutting elements disposed around a periphery of a bit body, and the adjustable cutting structure may include a pair of counter-rotational cutting members centrally located on the bit body nearer the rotational axis of the bit body. Rotation of the drill bit carries any peripherally-located fixed cutting elements on the bit body along a relatively long circumferential path which may facilitate shearing of geologic material from a formation. Simultaneously with rotation of the drill bit to carry the peripherally-located fixed cutting elements along their relatively-long circumferential paths, the adjustable cutting structure (e.g., pair of counter-rotational cutting members) may roll in a relatively short circumferential area to crush and scrape geologic material nearer to a rotational axis of the drill bit than the peripherally-located fixed cutting elements. The adjustable cutting structure includes an adjustment mechanism to allow the adjustable cutting structure (along with the one or more cutting elements thereon) to be supported at any of a plurality of axial positions with respect to the bit body. The adjustment mechanism may include, for example, a threaded, splined or other torque transmitting mating feature that would allow axial displacement of the adjustable cutting structure. The adjustable cutting structure may be movable between discrete axial positions, or alternatively over a continuous range of axial position.

Figure 1:
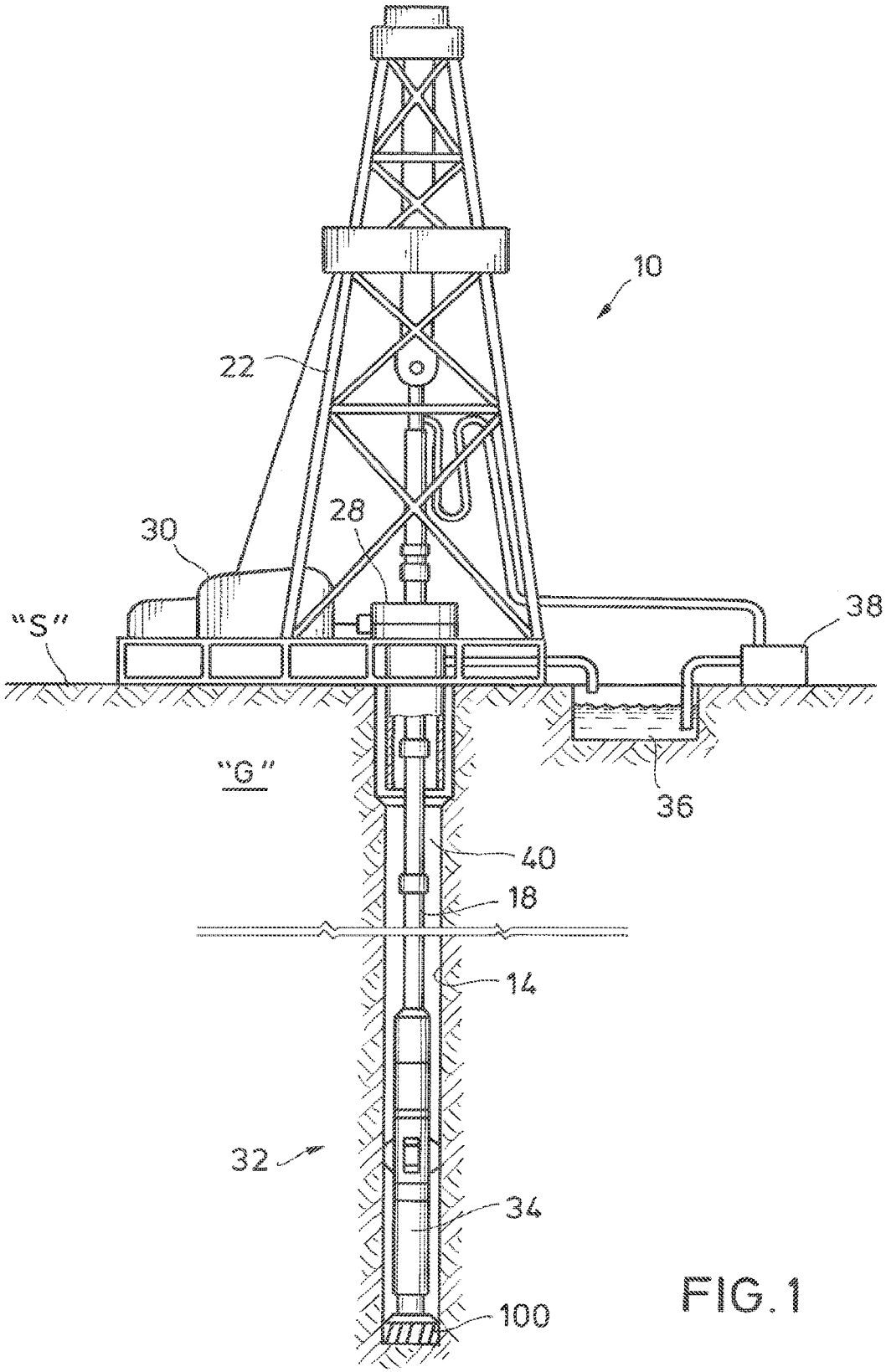
FIG. 1 is a partially cross-sectional side view of a drilling system including a hybrid drill bit in operation in a terrestrial drilling environment.

FIG. 1 is an elevation view of an example of a drilling system 10 that may incorporate a hybrid drill bit 100. The drilling system 10 is partially disposed within a wellbore 14 extending from a surface location "S" and traversing a geologic formation "G." In the illustrated example, the wellbore 14 is shown generally vertical, though the wellbore 14 may include any of a wide variety of vertical, directional, deviated, slanted and/or horizontal portions therein, and may extend along any trajectory through the geologic formation "G."

The hybrid drill bit 100 is provided at a lower end of a drill string 18 for cutting into the geologic formation "G." When rotated, the hybrid drill bit 100 operates to break up the geological formation "G." The hybrid drill bit 100 may be rotated in any of a variety of ways. In this example, at the surface location "S" a drilling rig 22 includes a turntable 28 that may be operated to rotate the entire drill string 18 and the hybrid drill bit 100 coupled to the lower end of the drill string 18. The turntable 28 is selectively driven by an engine 30, chain-drive system, or other apparatus. A bottom hole assembly or BHA 32 may be provided in the drill string 18 may include a downhole motor 34 to selectively rotate the hybrid drill bit 100 with respect to the rest of the drill string 18. The motor 34 may generate torque in response to the circulation of a drilling fluid, such as mud 36, therethrough. The ability to selectively rotate the hybrid drill bit 100 relative to the drill string 18 may be useful in directional drilling, and/or for other operations as well.

The mud 36 can be pumped downhole by mud pump 38 through an interior of the drill string 18. The mud 36 passes through the downhole motor 34 of the BHA 32 where energy is extracted from the mud 36 to turn the hybrid drill bit 100. As the mud 36 passes through the BHA 32, the mud 36 may lubricate bearings (not explicitly shown) defined therein before being expelled through nozzles 124 (FIG. 2) defined in the hybrid drill bit 100. The mud 36 flushes geologic cuttings and/or other debris from the path of the hybrid drill bit 100 as it continues to circulate back up through an annulus 40 defined between the drill string 18 and the geologic formation "G." The geologic cuttings and other debris are carried by the mud 36 to the surface location "S" where the cuttings and debris can be removed from the mud stream.

Figure 2:
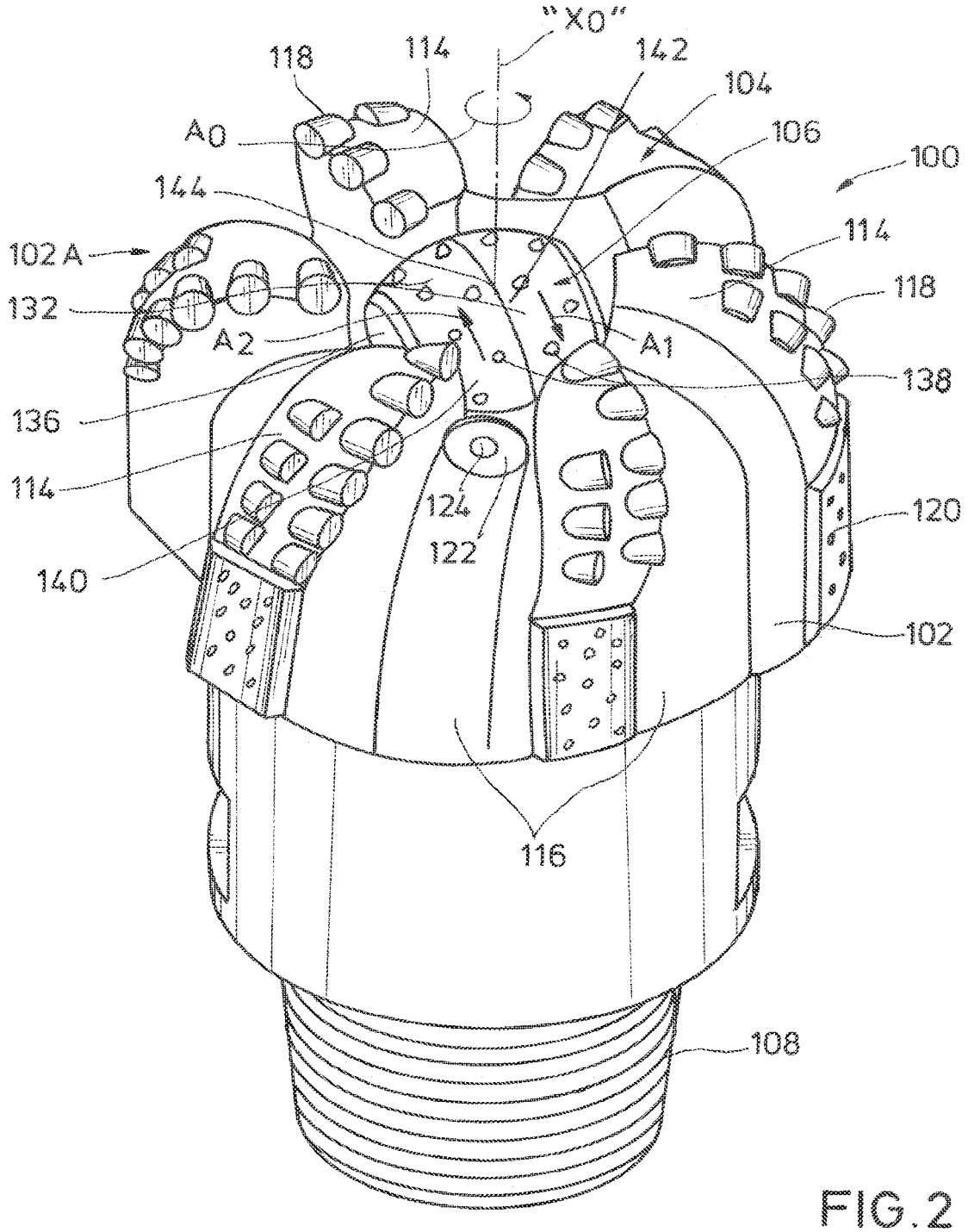
FIG. 2 is a perspective view of the hybrid drill bit of FIG. 1 illustrating a peripherally-located fixed cutting structure defined by a bit body and a centrally-located, counter-rotational adjustable cutting structure circumscribed by the peripherally-located fixed cutting structure.

FIG. 2 is a perspective view of the hybrid drill bit 100 illustrating a bit body 102 defining a peripherally-located fixed cutting structure 104 and a centrally-located, counter-rotational, adjustable cutting structure 106 generally circumscribed by the fixed cutting structure 104. Hybrid drill bit 100 may also include any of various types of connectors 108 extending from the bit body 102 for coupling the hybrid drill bit 100 to the drill string 18 (FIG. 1). The connector 108 may include a threaded pin with American Petroleum Institute (API) threads defined thereon.

The bit body 102 defines a hit body rotational axis "$X_0$" extending between a leading end 102A and a trailing end 102B thereof. The bit body 102 may be constructed of a metallic material such as steel or any of various metal alloys generally associated with manufacturing rotary drill bits. Alternatively, the bit body 102 may be constructed of matrix material formed by infiltrating a reinforcement material, e.g., tungsten carbide powder with a molten binder material, e.g., copper, tin, manganese nickel and zinc.

The peripherally-located fixed cutting structure 104 includes a plurality of cutting blades 114 circumferentially spaced about the adjustable cutting structure 106 with junk slots 116 defined between the cutting blades 114. The six (6) cutting blades 114 may be asymmetrically arranged about the bit body rotational axis "$X_0$." The junk slots 116 facilitate the removal of geologic materials and debris from the path of the hybrid drill bit 100, e.g., by providing a flow path for drilling mud 36 (FIG. 1) around the bit body 102.

The cutting blades 114 support a plurality of fixed cutting elements 118 thereon axially and radially spaced about the adjustable cutting structure 106. As used herein the term "fixed" generally means that the fixed cutting elements 118 are mounted for maintaining a position and orientation with respect to the bit body 102 as the hybrid drill bit 100 is rotated about the bit body rotational axis "$X_0$." The fixed cutting elements 118 may be securely mounted to the cutting blades 114 by brazing or other manufacturing techniques recognized in the art. One or more of the fixed cutting elements 118 may be coupled to the hit body 102 by an adjustment mechanism (described in greater detail below) that permits the fixed cutting element 118 to maintain a circumferential position on the leading end 102A of the hit body 102 while being statically or dynamically supported in a plurality of different axial positions with respect to the bit body 102. The fixed cutting elements 118 engage and remove adjacent portions of the geologic formation "G" (FIG. 1), generally by shearing the geologic materials from the bottom and sides of a wellbore 14 (FIG. 1) as the hybrid drill bit 100 rotates downhole. The fixed cutting elements 118 may include various types of polycrystalline diamond compact (PDC) cutter components.

Gauge elements 120 are provided on radially outward surface at a trailing end of each cutting blade 114. The gauge elements 120 may be constructed of any of the hard materials described above for construction of the fixed cutting elements 118 and operate to maintain a diameter of the wellbore 14 (FIG. 1).

A plurality of nozzle openings 122 may be defined in the bit body 102. Respective nozzles 124 may be disposed in each nozzle opening 122 for expelling various types of drilling fluid or mud 36 (FIG. 1) pumped through the drill string 18 (FIG. 1). The nozzle openings 122 are fluidly coupled to a fluid passageway 128 (FIG. 3) extending through the hybrid drill bit 100. The centrally-located adjustable cutting structure 106 may also include nozzles (not explicitly shown) that are fluidly coupled to the fluid passageway 128. The fluid passageway 128 extends through the bit body 102 and the connector 108 such that the fluid passageway 128 may be fluidly coupled to the drill string 18 (FIG. 1).

The adjustable cutting structure 106 is radially disposed adjacent the bit body rotational axis "$X_0$" such that the adjustable cutting structure 106 is generally circumscribed by the fixed cutting structure 104. The adjustable cutting structure 106 includes a pair of counter-rotational cutting members 132 rotatably coupled to the bit body 102 by a roller axle 136. The axle 136 may be mounted in a fixed circumferential orientation with respect to the bit body 102, e.g., the axle 136 rotates with the bit body about the bit body rotational axis "$X_0$." As described in greater detail below, the axle 136 may be dynamically or statically supported by an adjustment mechanism at a plurality of axial positions with respect to the bit body rotational axis "$X_0$." The counter-rotational cutting members 132 are mounted for counter-rotation with respect to one another about the axle 136. Each counter-rotational cutting member 132 is radially displaced from the hit body rotational axis "$X_0$," and thus the counter-rotational cutting members 132 may be induced to rotate on the axle 136 upon rotation of the hybrid drill bit 100. For example, rotation of the hybrid drill bit 100 adjacent the geologic formation "G" (FIG. 1) in the direction of arrow $A_0$ about the bit body rotational axis "$X_0$" induces rotation of a first counter-rotational cutting member 132 in the direction $A_1$ and rotation of a second counter-rotational cutting member 132 in the opposite direction of arrow $A_2$ about the axle 136. The rotation about the axel 136 is due in part to frictional forces between the geologic formation "G" and the counter-rotational cutting members 132 that induce rolling of the of the counter-rotational cutting members 132 along a circumferential path around the bit body rotational axis "$X_0$."

Figure 3:
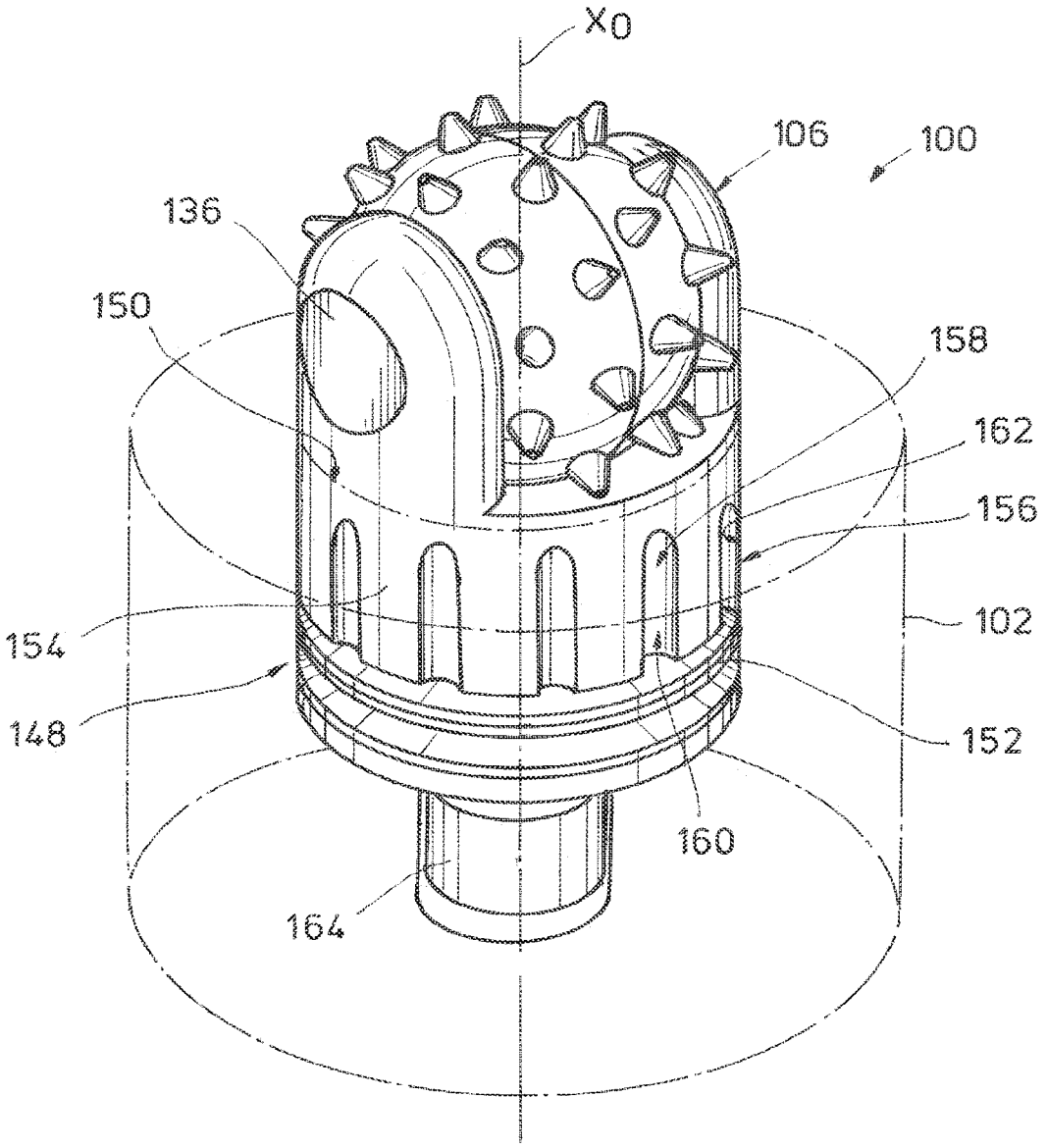
FIG. 3 is a simplified perspective view of the hybrid drill bit of FIG. 2 with the bit body depicted schematically to illustrate an adjustment mechanism coupled between the bit body and the counter-rotational adjustable cutting structure for dynamically supporting the counter-rotational adjustable cutting structure at a plurality of axial positions within the bit body with a stack of flexible spacer members.

The counter-rotational cutting members 132 support cutting elements 138 thereon. The cutting elements 138 may generally operate to crush and scrape geologic material near the bit body rotational axis "$X_0$" of the hit body 102. In the illustrated example, the cutting elements 138 protrude from a generally hemispherical surface 140 of the counter-rotational cutting members 132. The counter-rotational cutting members 132 are arranged such that the respective hemispherical surfaces 140 define a generally spherical profile across a leading end 142 of the counter-rotational adjustable cutting structure 106. An apex 144 of the generally spherical profile may be disposed generally along the bit body rotational axis "$X_0$," and it should be appreciated that the apex 144 may be radially offset from bit body rotational axis "$X_0$." The apex 144 may be radially offset from the bit body rotational axis "$X_0$" such that one of the counter-rotational cutting members 132 intersects the bit body rotational axis "$X_0$" and the counter-rotational cutting members 132 extend to opposite radial sides of the bit body rotational axis "$X_0$." The cutting elements 138 may be arranged in circumferential rows around the hemispherical surfaces 140. To facilitate counter-rotation of the counter-rotational cutting members 132 (e.g., rotation in opposite directions about axle 136) a respective radially inner-most circumferential row 138*a*, 138*b* (FIG. 4) of cutting elements 138 on each of the rotational cutting members 132 may be disposed on opposite radial sides of the bit body rotational axis "$X_0$" as illustrated in FIG. 3. Other arrangements for cutting elements 138 on the counter-rotational cutting members 132 are also contemplated such as protrusions or recesses in any random or patterned arrangement on the counter-rotational cutting members 132.

FIG. 3 is a simplified perspective view of the hybrid drill bit 100 with the bit body 102 depicted schematically to illustrate an adjustment mechanism 148 coupled between the hit body 102 and the counter-rotational adjustable cutting structure 106. The adjustment mechanism 148 is operable for dynamically supporting the adjustable cutting structure 106 at a plurality of axial positions within a central aperture 150 defined in the bit body 102. As used herein, a "dynamic" adjustment mechanism includes those structures which permit the axial position of an adjustable cutting structure 106 to be adjusted while the drill bit 100 is operating within a wellbore 14 (FIG. 1). To permit dynamic adjustment, the adjustment mechanism 148 includes a stack of flexible spacer members 152 that can be axially compressed, e.g., by applying an appropriate weight on bit. As the stack of spacer members 152 is compressed, the adjustable cutting structure 106 moves in the axial direction of arrow $A_3$, into the central aperture 150 of the bit body 102. The weight on bit may be relieved to permit the spacer members 152 to axially expand and move the adjustable cutting structure 106 in the direction of arrow $A_4$. The exposure or height of the counter rotational adjustable cutting structure 106 is thereby dynamically adjusted. The spacer members 152 may include Bellville washers, wave washers or other disc springs recognized in the art. Alternatively or additionally, the spacer members 152 may include one or more compression springs or other structures that may be preloaded such that the amount of weight on bit that must be applied to induce movement of the adjustable cutting structure 106 may be predetermined.

The adjustment mechanism 148 includes a forked axle support 154. The axle supports 166 may hold the axle 136 in a generally orthogonal orientation to the bit body rotational axis "$X_0$." The forked axle support 154 has a splined outer surface 156. The splined outer surface 156 includes a plurality of grooves 158 that correspond with a plurality of keys 160 defined on an inner surface 162 of the central aperture 150 in the bit body 102. The grooves 158 and keys 160 permit torque to be transmitted between the bit body 102 and adjustable cutting structure 106 while permitting axial movement there between. Although not shown, the corresponding surfaces 156 may include other features such as helical splines, straight splines or other structures that permit axial movement and the transmission of torque. Outer surfaces 156 with a rectangular, triangular or any non-circular cross section may be provided for the transmission of torque with a similarly shaped inner surface 162. The adjustment mechanism 148 also includes a fastener 164, which secures the forked axle support 154 to the bit body 102.

Figure 4:
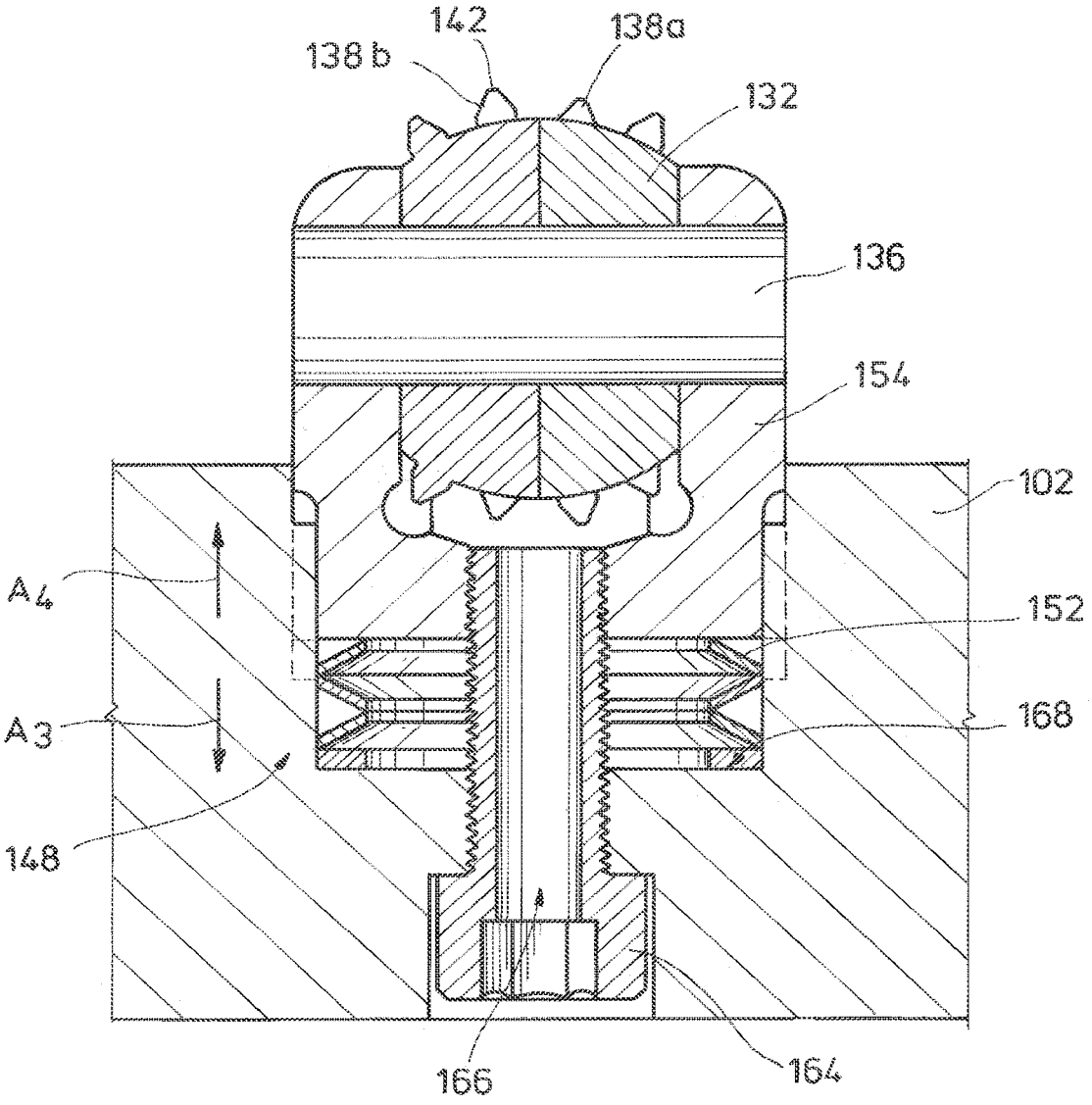
FIG. 4 is a cross-sectional view of the hybrid drill bit of FIG. 3.

FIG. 4 is a cross sectional view of the hybrid drill bit 100. The stack of flexible spacer members 152 is supported on an interior shoulder 168 within the bit body 102, and the forked axle support 154 is supported on the stack of flexible spacer members 154. The fastener 164 extends through the flexible spacer member 154 and threads into the forked axle support 154. The fastener 164 may include a fluid passage 166 extending therethrough to permit drilling fluids to reach the counter-rotational cutting members 132. The degree to which the fastener 164 threads into the forked axle support 154 determines the degree to which the flexible spacer members 154 are compressed against the shoulder 168, and thereby defines the preload applied to the flexible spacer members 154.

The axial position of the adjustable cutting structure 106 within the bit body 102 defines a cutting depth that may be achieved by the fixed cutting elements 118 (FIG. 2). Generally, where the counter-rotational cutting members 132 axially lead the fixed cutting elements 118 to a greater extent, a greater portion of axial forces applied to the drill bit 100 may be transferred to the geologic formation "G" (FIG. 1) through the counter-rotational cutting members 132 than through the fixed cutting elements 118. Thus, the fixed cutting elements 118 may achieve a relatively low cutting depth. Conversely, where the counter-rotational cutting members 132 axially lead the fixed cutting elements 118 to a lesser extent, or where the counter-rotational cutting members 132 axially trail the fixed cutting elements 118, a greater portion of axial forces applied to the drill bit 100 may be transferred to the geologic formation "G" through the fixed cutting elements 118 than through the counter-rotational cutting members 132, and thus, the fixed cutting elements 118 may achieve a relatively high cutting depth.

Although not shown, the adjustable cutting structure 106 may be underexposed. For example, the leading end 142 of the of the counter-rotational cutting members 132 may be disposed within the central aperture 150, and the leading end 142 may be disposed to trail each of the fixed cutting elements. The counter rotational adjustable cutting structure 106 may also be overexposed such that the leading end 142 is disposed on a leading axial side of each of the fixed cutting elements 118 (FIG. 2).

With continued reference to FIGS. 1 through 4, the hybrid drill bit 100 may be employed for forming wellbore 14 through geologic formation "a" The geologic formation "G" may be evaluated at various depths to assess an appropriate range of axial positions for the adjustable cutting structure 106 with respect to the fixed cutting elements 118. For example, the type of geologic materials within the geologic formation "G" may be assessed to determine an appropriate cutting depth for the fixed cutting elements 118 at each of the various depths evaluated. An initial axial position of the adjustable cutting structure 106 may be defined by selecting and installing an appropriate number, size and shape of flexible spacer members 152, and torqueing the fastener 164 sufficiently to preload the flexible spacer members 152 and achieve the desired initial axial position.

Next, the hybrid drill bit 100 may be coupled to the drill string 18 with the connector 108, and the bit body 102 of the hybrid drill bit 100 may be rotated about the bit body rotational axis "$X_0$" adjacent the geologic formation "G" with an initial weight on bit applied. The initial weight on bit may be below a threshold force at which the flexible spacer members begin to axially compress. Thus, the counter rotational adjustable cutting structure 106 and the cutting elements 138 at the leading end 142 thereof are maintained at the initial axial position with respect to the bit body 102. By rotating the bit body 102, geologic material may be sheared from the geologic formation "G" with the fixed cutting elements 118. The rotation of the bit body 102 causes the counter-rotational cutting members 132 to roll in opposite directions along the geologic formation "G." The first counter-rotational cutting member 132 rolls in the direction of arrow $A_1$, and the second counter-rotational cutting member 132 rolls in the direction of arrow $A_2$. The roller elements 132 both rotate about the axle 136, which may be generally orthogonal to the bit body rotational axis "$X_0$." Geologic material from the geologic formation "G" is thereby crushed and scraped with the cutting elements 138 near the bit body rotational axis "$X_0$."

When it is desired to change the axial position of the counter-rotational adjustable cutting structure 106, e.g., when changes in the characteristics (hardness, density, etc.) of the geologic formation "G" are encountered, the weight on bit may be increased above the threshold force at which the flexible spacer members 152 are compressed. The adjustable cutting structure 106 is thereby induced to withdraw into the central aperture 150 in the direction of arrow $A_3$. The fixed cutting elements 118 may then lead the counter-rotational cutting members 132 by a relatively greater extent and a greater portion of axial forces applied to the drill bit 100 may be transferred to the geologic formation "G" through the fixed cutting elements 118. Thus, the fixed cutting elements 118 may achieve a relatively high cutting depth. When changes in the characteristics of the geologic formation "G" are again encountered, the weight on bit may be reduced to allow the flexible spacer members 152 to push the counter rotational adjustable cutting structure 106 in a leading direction of arrow $A_4$. The fixed cutting elements 118 may achieve a relatively low cutting depth through the relatively hard formation material. The wear and tear experienced by the fixed cutting elements may be controlled in this manner.

Also, changes in the axial position of the counter-rotational adjustable cutting structure 106 may be realized as vibrational energy is imparted to the drill bit 100. For example, when drilling through a relatively hard portion of geologic formation "G," vibrational energy may cause the flexible spacer members 152 to be compressed and expanded to thereby induce changes in the axial position of the counter-rotational adjustable cutting structure 106. In this manner, the flexible spacer members 152 may serve as dampeners to mitigate deleterious effects of vibration.

Figure 5:
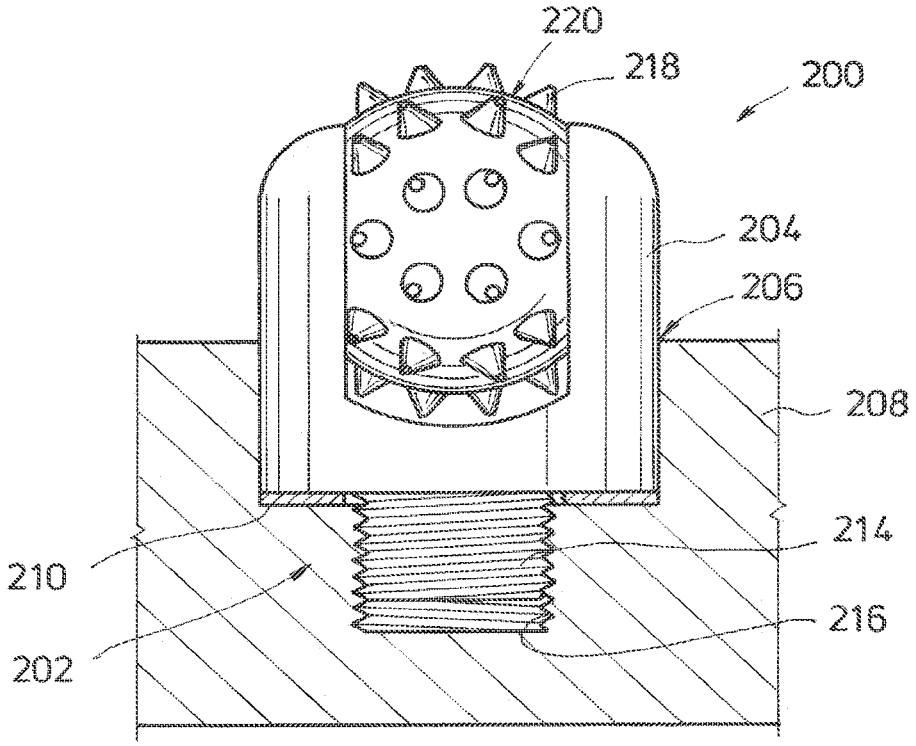
FIG. 5 is a cross-sectional view of a drill bit illustrating an adjustment mechanism according to an alternate example wherein an adjustable cutting structure is statically supported at one of a plurality of possible axial positions within the bit body by a substantially rigid spacer.

FIG. 5 is a cross-sectional view of another example of a hybrid drill bit 200 illustrating an adjustment mechanism 202. An adjustable cutting structure 204 is statically supported at one of a plurality of possible axial positions within a central aperture 206 defined in a hit body 208. One or more substantially rigid spacers 210 may be provided within the central aperture 206 to define the axial position of adjustable cutting structure 204 with respect to the bit body 208. The adjustable cutting structure 204 includes a threaded shank 214 that engages a correspondingly threaded surface 216 of the central aperture 206. The number and thickness of the spacers 210 determine the distance the threaded shank 214 will thread into the central aperture 206, and thereby defines the axial position of the adjustable cutting structure 204 with respect to the bit body 208. The substantially rigid spacers 210 may comprise flat steel washers.

The adjustment mechanism 202 may be described as a "static" adjustment mechanism since the axial position of the adjustable cutting structure 204 is maintained as the drill bit 200 is operating within a wellbore 14 (FIG. 1). When it is desired to alter the axial position of the adjustable cutting structure 204, the drill bit 200 may be withdrawn from the wellbore 14 (FIG. 1) and the adjustable cutting structure 204 may be unthreaded from the bit body 208 to permit the number and/or size of the substantially rigid spacer members 210 to be altered. The adjustable cutting structure 204 may then be replaced, and will engage the substantially rigid spacer member 210 to be supported at a different axial position with respect to the bit body 208.

The adjustable cutting structure 204 includes cutting elements 218 at a leading end 220 thereof. The cutting elements 218 may be fixed cutting elements such that the axial position of the cutting elements 218 with respect to the bit body 208 is fixed once the adjustable cutting structure 204 is installed within the central aperture. Alternatively or additionally, the cutting elements 218 may be supported for counter rotation about an axle as described above. In either case, the axial position of the cutting elements 218 at the leading end 220 of the adjustable cutting structure 204 is adjustable by selecting the number and size of the spacer members 210.

Figure 6:
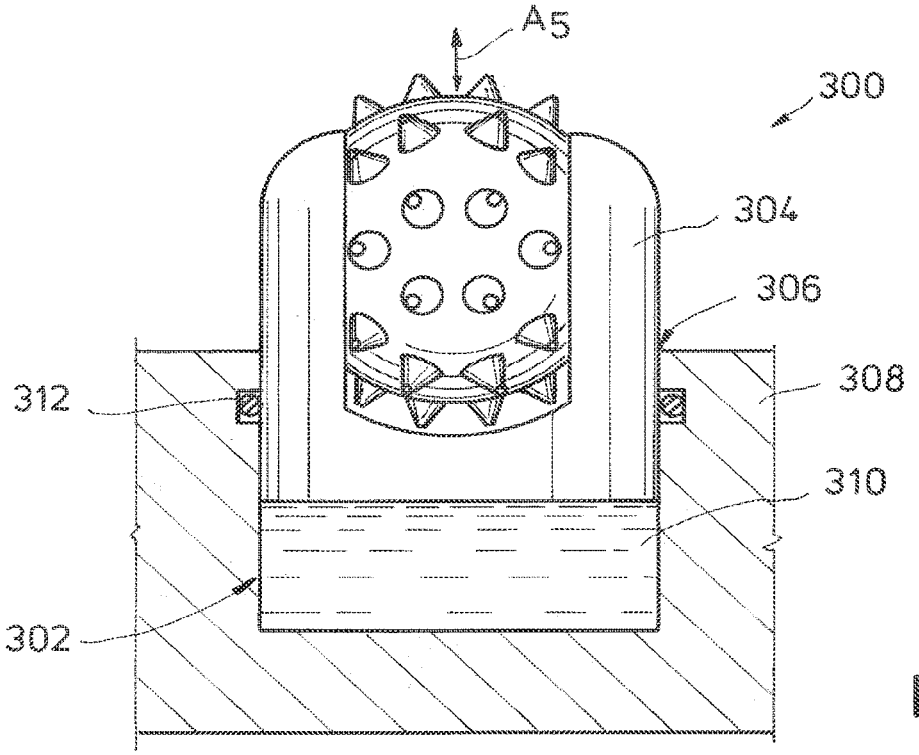
FIG. 6 is a cross-sectional view of another example of a hybrid drill bit illustrating a dynamic adjustment mechanism for supporting a counter-rotational adjustable cutting structure with a cavity filled with a support material.

FIG. 6 is a cross-sectional view of another example of a hybrid drill bit 300 illustrating a dynamic adjustment mechanism 302 for supporting a counter-rotational adjustable cutting structure 304. The adjustment mechanism 302 includes a cavity 306 defined in a hit body 308, which may be filled with a support material 310. The support material 310 may include a fluid such as a compressible gas, which may function as a spring between the adjustable cutting structure 304 and the body 308, or a liquid such as oil, which may provide dampening to the adjustable cutting structure 304. A seal 312 may be provided between the bit 308 body and the adjustable cutting structure 304 to maintain a fluid support material 310 within the cavity 306. The seal 312 may be constructed of an elastomeric o-ring or other structure, which permits axial movement of the adjustable cutting structure 304, e.g., in the directions of arrows $A_5$, in response to changes in the weight applied on the drill bit 300.

The support material 310 may include a viscoelastic material or a hyper-elastic material such as rubber. The support material 310 may provide shock absorption for the adjustable cutting structure 304 as axial forces are applied to the leading end of the adjustable cutting structure 304.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a drill bit for forming a wellbore through a geologic formation. The drill bit includes a connector configured for connection to a drillstring and a bit body coupled to the connector. The bit body defines a bit body rotational axis extending longitudinally therethrough. An adjustable cutting structure is mounted on the bit body and includes at least one cutting element protruding from a leading end of the bit body for penetrating the geologic formation. An adjustment mechanism is coupled between the bit body and the adjustable cutting structure for supporting the adjustable cutting structure: at a plurality of axial positions with respect to the bit body such that the exposure of the leading end of the adjustable cutting structure may be adjusted.

The adjustment mechanism may include at least one flexible spacer member disposed between the adjustable cutting structure and the bit body to dynamically support the adjustable cutting structure. The at least one flexible spacer member may include a spring under a spring preload force between the adjustable cutting structure and the bit body to prevent axial movement of the adjustable cutting structure at axial forces below a threshold related to the spring preload force. The adjustable cutting structure may maintain an axial position with respect the bit body in response to axial forces below the predetermined threshold force and the adjustable cutting structure may compress the spring to move axially with respect to the bit body in response to axial forces above the predetermined threshold force. The adjustment mechanism may include corresponding splined surfaces that permit both axial movement between the adjustable cutting structure and the bit body and the transmission of torque between the adjustable cutting structure and the bit body.

The drill bit may include a fixed cutting structure including at least one fixed cutting element mounted on the bit body for rotation with the bit body about the bit body rotational axis. The fixed cutting structure may include a plurality of fixed cutting elements mounted on the bit body and circumscribing the adjustable cutting structure.

The adjustable cutting structure may include one or more rotational cutting members mounted about a roller axel obliquely supported with respect to the bit body rotational axis on the adjustable cutting structure. The roller axel may be generally perpendicularly arranged with respect to the bit body rotational axis.

The adjustment mechanism may include a cavity defined in the bit body that is filled with a support material selected from the group consisting of a compressible gas, a liquid, a viscoelastic material and a hyper-elastic material. The adjustment mechanism may statically support the adjustable cutting structure on at least one substantially rigid spacer member disposed between the adjustable cutting structure and the bit body In another aspect, the disclosure is directed to a drill bit for forming a wellbore through a geologic formation that includes a connector configured for connection to a drillstring, a bit body coupled to the connector and defining a bit body rotational axis extending longitudinally therethrough, a fixed cutting structure mounted on the bit body and including at least one fixed cutting element thereon for rotation with the bit body about the bit body rotational axis, an adjustable cutting structure mounted on the hit body and including at least one cutting element protruding from a leading end of the bit body for penetrating the geologic formation, and an adjustment mechanism coupled between the bit body and the adjustable cutting structure for supporting the adjustable cutting structure at a plurality of axial positions with respect to the at least one fixed cutting element.

The fixed cutting structure may include a plurality of fixed cutting elements peripherally mounted on the bit body and circumscribing the adjustable cutting structure. The adjustable cutting structure may extend from a centrally-located aperture defined within the bit body. The adjustment mechanism may include correspondingly threaded surfaces defined on the adjustable cutting structure and the aperture, and at least one spacer member disposed within the adjustment mechanism for defining the degree of engagement between the correspondingly threaded surfaces.

The adjustable cutting structure may include one or more rotational cutting members mounted about respective roller axe's obliquely supported with respect to the bit body rotational axis on the adjustable cutting structure. The one or more rotational cutting members may include a pair of counter-rotational cutting members extending to opposite radial sides of the bit body rotational axis. The adjustment mechanism may dynamically support the adjustable cutting structure on at least one flexible spacer member disposed between the adjustable cutting structure and the bit body. The adjustable cutting structure may be coupled to the bit body by at least one fastener, and the fastener may be operable to selectively apply a predetermined preload to the at least one flexible spacer member.

In another aspect the disclosure is directed to a method of operating a drill bit for forming a wellbore through a geologic formation. The method includes (a) rotating a bit body of a drill bit adjacent the geologic formation to engage a fixed cutting structure mounted on a leading end of the bit body and an adjustable cutting structure at the leading end of the bit body with the adjustable cutting structure disposed at an initial axial position with respect to the fixed cutting structure, (b) adjusting the axial position of the adjustable cutting structure with respect to the fixed cutting structure, and (c) rotating the bit body with the adjustable cutting structure disposed at a second axial position with respect to the fixed cutting structure that is different than the initial axial position. Adjusting the axial position of the adjustable cutting structure may include altering a weight on bit applied to the drill bit.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A drill bit for forming a wellbore through a geologic formation, the drill bit comprising:

a connector configured for connection to a drillstring, a bit body coupled to the connector and defining a bit body rotational axis extending longitudinally therethrough;

a fixed cutting structure including at least one fixed cutting element mounted on the bit body for rotation with the bit body about the bit body rotational axis;

an adjustable cutting structure mounted on the bit body, the adjustable cutting structure including at least one cutting element protruding from a leading end of the bit body for penetrating the geologic formation;

an adjustment mechanism disposed between the bit body and the adjustable cutting structure for supporting the adjustable cutting structure at a plurality of axial positions with respect to the bit body wherein the adjustment mechanism statically supports the adjustable cutting structure at a fixed axial position with respect to the bit body on at least one substantially rigid spacer member disposed between the adjustable cutting structure and the bit body, the fixed axial position with respect to the bit body dependent upon a thickness of the at least one substantially rigid spacer member; and at least one torque transmitting mating feature defined between the bit body and the adjustable cutting structure;

wherein the at least one cutting element is rotationally coupled to the bit body and defines a leading end of the adjustable cutting structure such that the at least one cutting element protruding from the leading end of the bit body is both rotationally coupled to the bit body and axially adjustable with respect to the bit body; and wherein the torque transmitting mating feature comprises correspondingly threaded surfaces defined on the adjustable cutting structure and the bit body.

2. The drill bit of claim 1, wherein the fixed cutting structure comprises a plurality of fixed cutting elements mounted on the bit body and circumscribing the adjustable cutting structure.

3. The drill bit of claim 1, wherein the adjustable cutting structure further comprises one or more rotational cutting members mounted about a roller axel obliquely supported with respect to the bit body rotational axis on the adjustable cutting structure.

4. The drill bit of claim 3, wherein the roller axel is generally perpendicularly arranged with respect to the bit body rotational axis.

5. The drill bit of claim 1, further comprising a fixed cutting structure mounted on the hit body, and wherein the fixed cutting structure comprises a plurality of fixed cutting elements peripherally mounted on the bit body and circumscribing the adjustable cutting structure.

6. The drill bit of claim 5, wherein the adjustable cutting structure extends from a centrally-located aperture defined within the bit body.

7. The drill bit of claim 1, wherein the at least one substantially rigid spacer member comprises a flat steel washer.

8. A drill bit for firming a wellbore through a geologic formation, the drill bit comprising:

a connector configured for connection to a drillstring, a bit body coupled to the connector and defining a bit body rotational axis extending longitudinally therethrough;

a fixed cutting structure mounted on the bit body and including at least one fixed cutting element thereon for rotation with the bit body about the bit body rotational axis;

an adjustable cutting structure mounted on the bit body, the adjustable cutting structure including at least one cutting element protruding from a leading end of the bit body for penetrating the geologic formation; and an adjustment mechanism disposed between the bit body and the adjustable cutting structure for supporting the adjustable cutting structure at a plurality of fixed axial positions with respect to the at least one fixed cutting element, wherein the adjustment mechanism statically supports the adjustable cutting structure at a fixed axial position with respect to the bit body on at least one substantially rigid spacer member disposed between a trailing surface of the adjustable cutting structure and a leading surface of the bit body, wherein the fixed cutting structure comprises a plurality of fixed cutting elements peripherally mounted on the bit body and circumscribing the adjustable cutting structure; and wherein the adjustable cutting structure extends from a centrally-located aperture defined within the bit body.

9. The drill bit of claim 8, wherein the adjustment mechanism comprises correspondingly threaded surfaces defined on the adjustable cuffing structure and the aperture.

10. The drill bit of claim 8, wherein the adjustable cutting structure further comprises one or more rotational cutting members mounted about respective roller axels obliquely supported with respect, to the bit body rotational axis on the adjustable cutting structure.

11. The drill bit of claim 6, wherein the one or more rotational cutting members comprises a pair of counter-rotational cutting members extending to opposite radial sides of the bit body rotational axis.

12. The drill bit of claim 8, wherein the at least one cutting element is rotationally coupled to the bit body and defines a leading end of the adjustable cutting structure such that the at least one cutting element protruding from the leading end of the bit body is both rotationally coupled to the bit body and axially adjustable with respect to the bit body.

13. The drill bit of claim 12, further comprising at least one torque transmitting mating feature defined between the bit body and the adjustable cutting structure.

14. The drill bit of claim 13, wherein the torque transmitting mating feature comprises correspondingly threaded surfaces defined on the adjustable cutting structure and the bit body.

15. The drill bit of claim 8, wherein the at least one cutting element is rotationally coupled to the bit body and defines a leading end of the adjustable cutting structure such that the at least one cutting element protruding from the leading end of the bit body is both rotationally coupled to the bit body and axially adjustable with respect to the bit body.

16. The drill bit of claim 15, wherein the at least one substantially spacer member comprises a flat washer and wherein the adjustable cutting structure includes a threaded shank that extends through the flat washer to engage a correspondingly threaded surface in the bit body.

17. A method of operating a drill bit for forming a wellbore through a geologic formation, the method comprising:

rotating a bit body of the drill bit adjacent the geologic formation to engage a fixed cutting structure mounted on a leading end of the bit body and an adjustable cuffing structure at the leading end of the bit body with the adjustable cutting structure disposed at an initial fixed axial position with respect to the fixed cutting structure;

altering a number or size of at least one substantially rigid spacer members between the adjustable cutting structure and the bit body to adjust the axial position of the adjustable cutting structure from the initial fixed axial position to a second fixed axial position with respect to the fixed cutting structure; and rotating the bit body with the adjustable cutting structure disposed at the second fixed axial position with respect to the fixed cutting structure that is different than the initial fixed axial position; and unthreading the adjustable cutting structure from the bit body to permit the number or size of at least one substantially rigid spacer members to be altered.

18. The method of claim 17, further comprising withdrawing the drill bit from the wellbore prior to altering the number of size of the at least one rigid spacer member.

19. A drill bit for forming a wellbore through a geologic formation, the drill bit comprising:

a connector configured for connection to a drillstring, a bit body coupled to the connector and defining a bit body rotational axis extending longitudinally therethrough;

a fixed cutting structure mounted on the bit body and including at least one fixed cutting element thereon for rotation with the bit body about the bit body rotational axis;

an adjustable cutting structure mounted on the bit body, the adjustable cutting structure including at least one cutting element protruding from a leading end of the bit body for penetrating the geologic formation; and an adjustment mechanism disposed between the bit body and the adjustable cutting structure for supporting the adjustable cutting structure at a plurality of fixed axial positions with respect to the at least one fixed cutting element, wherein the adjustment mechanism statically supports the adjustable cutting structure at a fixed axial position with respect to the bit body on at least one substantially rigid spacer member disposed between a trailing surface of the adjustable cutting structure and a leading surface of the bit body;

wherein the at least one cutting element is rotationally coupled to the bit body and defines a leading end of the adjustable cutting structure such that the at least one cutting element protruding from the leading end of the bit body is both rotationally coupled to the bit body and axially adjustable with respect to the bit body; and wherein the at least one substantially rigid spacer member comprises a flat washer and wherein the adjustable cutting structure includes a threaded shank that extends through the flat washer to engage a correspondingly threaded surface in the bit body.

20. The drill bit of claim 19, wherein the adjustable cutting structure further comprises one or more rotational cutting members mounted about a roller axel obliquely supported with respect to the bit body rotational axis on the adjustable cutting structure.

* * * * *